US011160349B1

(12) United States Patent
Manuel

(10) Patent No.: US 11,160,349 B1
(45) Date of Patent: Nov. 2, 2021

(54) LIPSTICK ASSEMBLY AND METHODS OF MAKING AND USING THE SAME

(71) Applicant: Mercedes Antoinette Manuel, Wilson, NC (US)

(72) Inventor: Mercedes Antoinette Manuel, Wilson, NC (US)

( * ) Notice: Subject to any disclaimer, the term of this patent is extended or adjusted under 35 U.S.C. 154(b) by 0 days.

(21) Appl. No.: 17/155,652

(22) Filed: Jan. 22, 2021

(51) Int. Cl.

| | |
|---|---|
| ***B43K 27/04*** | (2006.01) |
| ***A45D 40/02*** | (2006.01) |
| ***A45D 40/24*** | (2006.01) |
| ***A45D 34/06*** | (2006.01) |
| *A45D 40/00* | (2006.01) |

(52) U.S. Cl.
CPC ..... *A45D 40/02* (2013.01); *A45D 34/06* (2013.01); *A45D 40/24* (2013.01); *A45D 2040/0062* (2013.01); *A45D 2200/052* (2013.01)

(58) Field of Classification Search
CPC ..... A45D 40/02; A45D 40/24; A45D 34/06; A45D 2200/052
USPC ..... 401/34, 35, 176
See application file for complete search history.

(56) References Cited

U.S. PATENT DOCUMENTS

| | | | | |
|---|---|---|---|---|
| 2,171,794 | A * | 9/1939 | Jones | A45D 40/24 401/19 |
| 4,666,043 | A * | 5/1987 | Tahara | A45D 40/10 132/318 |
| 6,895,628 | B1 * | 5/2005 | Anderson | A45D 40/12 132/313 |
| 7,806,614 | B2 * | 10/2010 | Desson | A45D 40/02 401/65 |
| 8,231,294 | B2 * | 7/2012 | Grossnass | A45D 40/12 401/32 |
| 9,687,061 | B2 * | 6/2017 | Klapia | A45D 34/045 |
| 2005/0072801 | A1 * | 4/2005 | Chadfield | A45D 40/24 222/145.1 |
| 2010/0307520 | A1 * | 12/2010 | Dahle | A45D 40/18 132/200 |
| 2015/0305475 | A1 * | 10/2015 | Girod | A45D 40/04 401/31 |

* cited by examiner

*Primary Examiner* — Jennifer C Chiang
(74) *Attorney, Agent, or Firm* — Ashley D. Johnson; Dogwood Patent and Trademark Law

(57) ABSTRACT

The invention is a lipstick container assembly that houses a plurality of lipsticks. Specifically, the disclosed assembly includes a housing and a lid. The interior of the container includes a plurality of lipsticks that can be advanced from the container via a slide as desired by the user. Particularly, a desired lipstick color can be selected by the user. The corresponding compartment slide can be moved in an upward direction along a groove to elevate the desired lipstick from an outlet in the lid. The lipstick can then be applied as needed by a user. When the slide is manipulated in a downward direction, the lipstick is reverted into the container interior for storage.

20 Claims, 9 Drawing Sheets

LIPSTICK ASSEMBLY AND METHODS OF MAKING AND USING THE SAME

TECHNICAL FIELD

The presently disclosed subject matter relates generally to a lipstick assembly, and to methods of making and using the disclosed assembly.

BACKGROUND

For decades, cosmetics have been an essential part of most women's daily routine. Specifically, lipstick is generally a cosmetic that women carry with them for use at any time. Conventional lipstick tubes are cylindrical in shape and include a rotating housing that raises the lipstick for application to the user's lips. After use, the housing is rotated in a downward direction to pull the lipstick back inside the tube. A protective cap attaches to the housing to cover the lipstick when not in use. However, current lipstick containers suffer from several drawbacks. For example, if care is not taken to fully retract the lipstick back to the storage position, the lipstick can become smeared on the user and/or the cap, creating a mess. Further, if the cap is improperly positioned on the housing, it can distort the shape of the lipstick. The cap can also be easily dislodged from the lipstick tube, damaging the lipstick and causing a mess in the user's purse. In addition, users frequently apply more than one color lipstick at a time (e.g., to create an ombre effect). As a result, the user is required to carry several individual tubes of lipstick that must be located and stored before and after each use. It would therefore be beneficial to provide a lipstick assembly that overcomes the shortcomings of the prior art.

SUMMARY

In some embodiments, the presently disclosed subject matter is directed to a container for dispensing a lipstick. Particularly, the container comprises a housing comprising an open top and an interior defined by two or more compartments, wherein each compartment includes a cup slidable within the relative compartment. The housing also includes an exterior sidewall comprising two or more slides positioned within a vertical groove, wherein each slide is positioned adjacent to a compartment of the housing, and wherein each slide can move in an upward or downward direction within the vertical groove. The container includes a lid comprising two or more outlets, each outlet aligned with a compartment of the housing. When the slide moves in a direction along the groove, the cup aligned with the slide also moves in the same direction.

In some embodiments, each cup comprises a lipstick.

In some embodiments, each lipstick is a different color compared to other lipsticks housed within the container.

In some embodiments, the slide comprises one or more gripping elements.

In some embodiments, the interior of the housing comprises about 2-6 compartments.

In some embodiments, a bottom surface of each cup comprises a retention element to retain a lipstick therein.

In some embodiments, each cup includes a sidewall.

In some embodiments, the external surface of the housing comprises one or more gripping elements.

In some embodiments, the housing includes a plurality of indicators aligned with each compartment to indicate the associated color lipstick housed within a particular compartment.

In some embodiments, the housing and lid are constructed from one or more rigid materials selected from metal, plastic, ceramics, or combinations thereof.

In some embodiments, the presently disclosed subject matter is directed to a method of accessing a lipstick housed within a container. Particularly, the method comprises selecting a desired lipstick color from a container. The container comprises a housing comprising an open top and an interior defined by two or more compartments, wherein each compartment includes a cup slidable within the relative compartment. The housing also includes an exterior sidewall comprising two or more slides positioned within a vertical groove, wherein each slide is positioned adjacent to a compartment of the housing, and wherein each slide can move in an upward or downward direction within the vertical groove. The container includes a lid comprising two or more outlets, each outlet aligned with a compartment of the housing. When the slide moves in a direction along the groove, the cup aligned with the slide also moves in the same direction. A lipstick is positioned in each cup. The method also includes moving the slide along the groove in an upward direction, such that the cup of the desired lipstick compartment moves in an upward direction until at least a portion of the lipstick extends through the lid outlet, wherein the lipstick can be accessed as desired by a user.

BRIEF DESCRIPTION OF THE DRAWINGS

The previous summary and the following detailed descriptions are to be read in view of the drawings, which illustrate some (but not all) embodiments of the presently disclosed subject matter.

DETAILED DESCRIPTION

The presently disclosed subject matter is introduced with sufficient details to provide an understanding of one or more particular embodiments of broader inventive subject matters. The descriptions expound upon and exemplify features of those embodiments without limiting the inventive subject matters to the explicitly described embodiments and features. Considerations in view of these descriptions will likely give rise to additional and similar embodiments and features without departing from the scope of the presently disclosed subject matter.

Unless defined otherwise, all technical and scientific terms used herein have the same meaning as commonly understood to one of ordinary skill in the art to which the presently disclosed subject matter pertains. Although any methods, devices, and materials similar or equivalent to those described herein can be used in the practice or testing of the presently disclosed subject matter, representative methods, devices, and materials are now described.

Following long-standing patent law convention, the terms "a", "an", and "the" refer to "one or more" when used in the subject specification, including the claims. Thus, for example, reference to "a device" can include a plurality of such devices, and so forth.

Unless otherwise indicated, all numbers expressing quantities of components, conditions, and so forth used in the specification and claims are to be understood as being modified in all instances by the term "about". Accordingly, unless indicated to the contrary, the numerical parameters set forth in the instant specification and attached claims are approximations that can vary depending upon the desired properties sought to be obtained by the presently disclosed subject matter.

As used herein, the term "about", when referring to a value or to an amount of mass, weight, time, volume, concentration, and/or percentage can encompass variations of, in some embodiments +/−20%, in some embodiments +/−10%, in some embodiments +/−5%, in some embodiments +/−1%, in some embodiments +/−0.5%, and in some embodiments +/−0.1%, from the specified amount, as such variations are appropriate in the disclosed packages and methods.

Figure 1A:
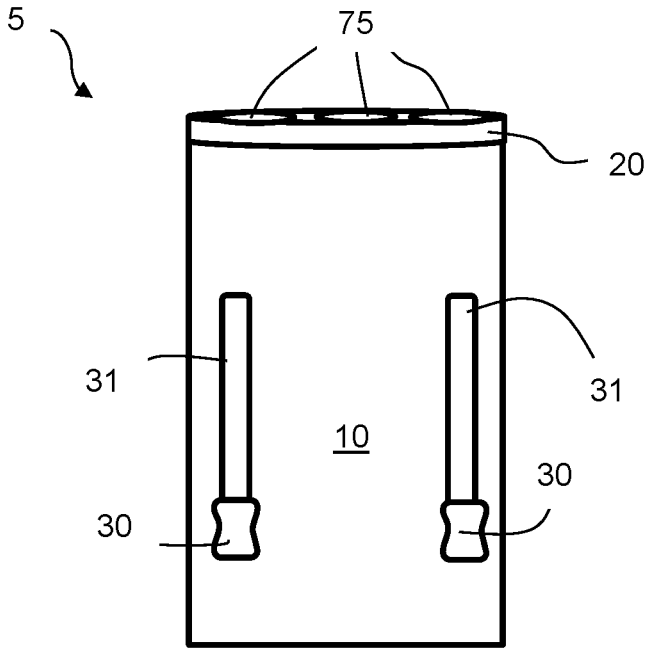
FIG. 1*a* is a perspective view of a lipstick container assembly in a storage configuration in accordance with some embodiments of the presently disclosed subject matter.
Figure 1B:
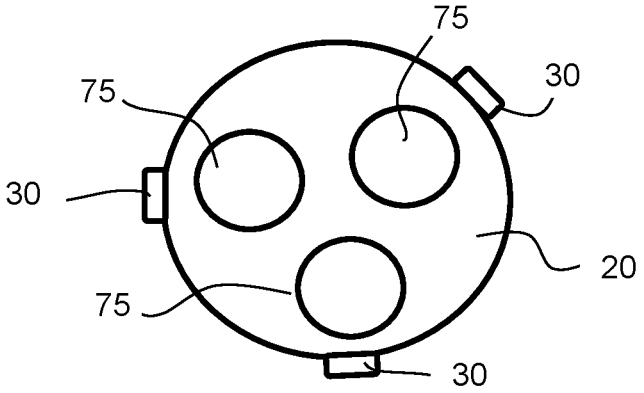
FIG. 1*b* is a top plan view of a lipstick container assembly in accordance with some embodiments of the presently disclosed subject matter.
Figure 1C:
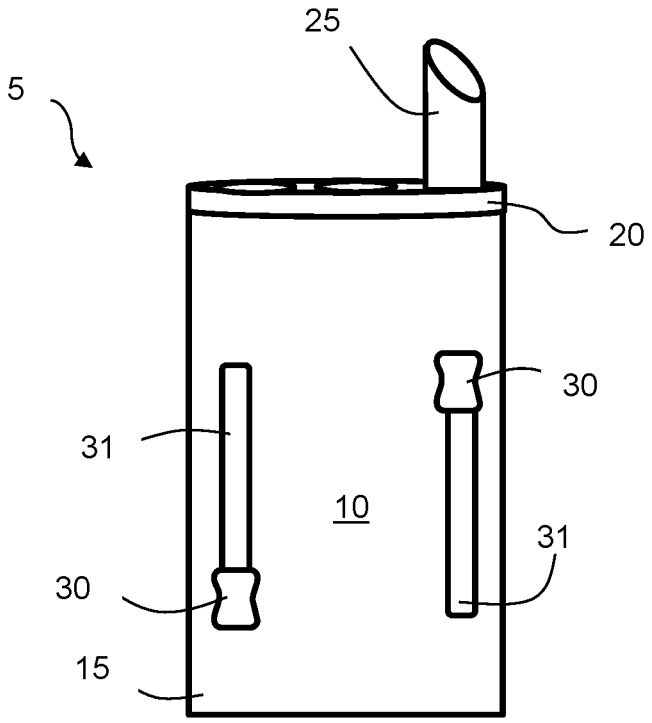
FIG. 1*c* is a perspective view of a lipstick container assembly in a use configuration in accordance with some embodiments of the presently disclosed subject matter.

The presently disclosed subject matter is generally directed to a lipstick container assembly that houses a plurality of lipsticks. FIG. 1*a* illustrates one embodiment of container 5 comprising housing 10 and lid 20. FIG. 1*a* illustrates the assembly in a closed position (e.g., with the lipsticks in a retracted or storage orientation within the assembly interior). The interior of the container includes a plurality of lipsticks 25 that can be advanced from the container via a series of slides 30 as desired by the user. Particularly, the interior of housing 10 includes one or more compartments that house a desired lipstick. Each compartment includes a corresponding slide that can be moved in an upward direction along groove 31 to elevate the desired lipstick from outlet 75 in lid 20, as shown in FIGS. 1*b* and 1*c*. The lipstick can then be applied as needed by a user. When slide 30 is manipulated in a downward direction, lipstick 25 is reverted into the container interior for storage.

As used herein, the term "lipstick" broadly refers to a cosmetic product typically made from wax or petroleum that provides surface coating and/or moisturizing to the lips of a user. The wax or petroleum foundation can include a pigment that is transferred to the user's lips to impart visible color. The lipstick can further include one or more optional conditioners, such as (but not limited to) sunscreens, flavorings, moisturizers, and the like. The term "lipstick" therefore includes traditional lipsticks, lip glosses, lip balms, and the like.

Figure 2A:
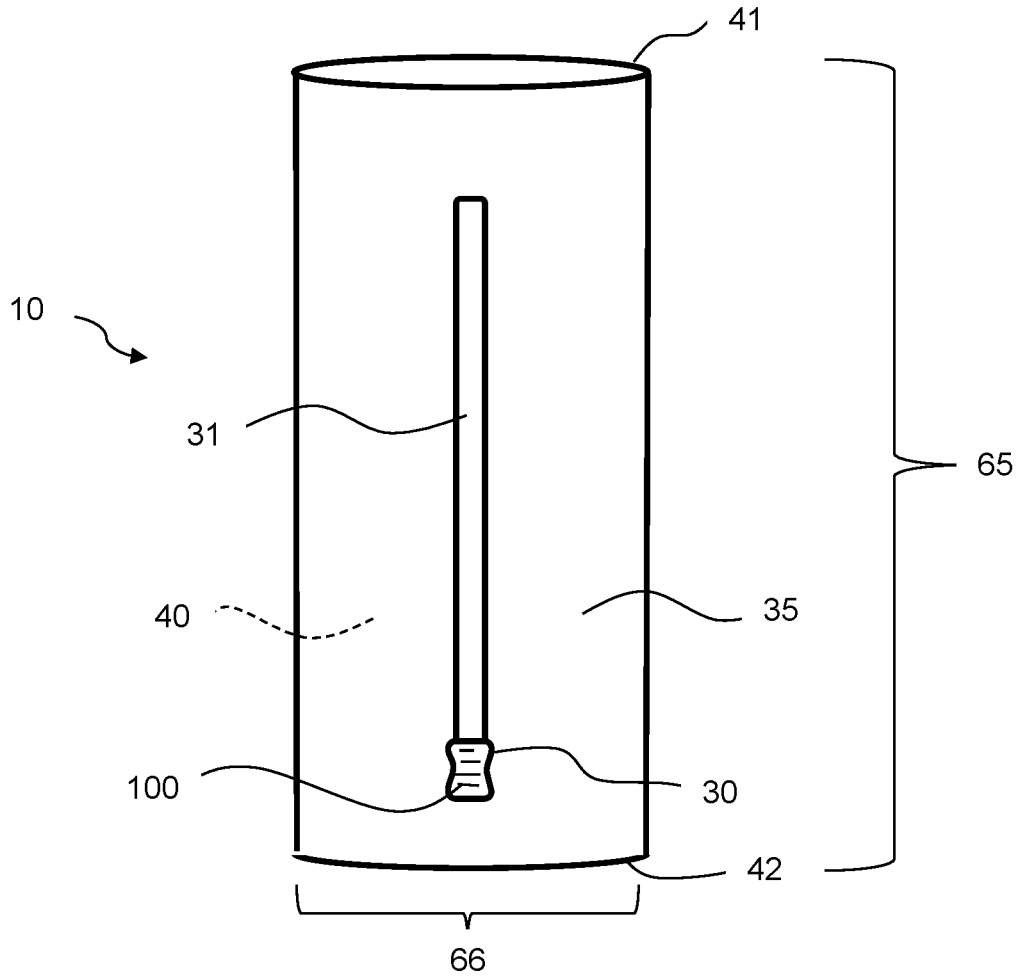
FIG. 2*a* is a front plan view of a container housing in accordance with some embodiments of the presently disclosed subject matter.

FIG. 2*a* illustrates one embodiment of container housing 10. As shown, the housing includes exterior surface 35 created by one or more sidewalls that join together to form top and bottom ends 41, 42. In some embodiments, sidewall of the housing can be configured in a cylindrical shape. However, the housing can have any desired cross-sectional shape, such as (but not limited to) circular, oval, square, rectangular, triangular, pentagonal, hexagonal, octagonal, abstract, and the like.

Top end 41 of the housing is at least partially open to allow a selected lipstick to exit the container housing and be accessed by the user, as described in detail below. In some embodiments, the top housing end can be threaded to allow for attachment of lid 20. The bottom end of the housing is closed to retain the lipsticks within the housing interior during storage.

Housing 10 can have length 65 of about 3-6 inches. Thus, the housing can have a length of about 3, 3.5, 4, 4.5, 5, 5.5, 6, 6.5, 7, 7.5, or 8 inches. Housing 10 can also include a width 66 of about 3-8 inches (e.g., at least/no more than about 3, 3.5, 4, 4.5, 5, 5.5, 6, 6.5, 7, 7.5, or 8 inches). The term "length" refers to the longest vertical distance of an element (e.g., from the top face to the bottom face). The term "width" refers to the longest distance perpendicular to the length (e.g., from a first side to an opposing side of an element). It should be appreciated that the housing is not limited and can include and a length and/or width outside the range given above.

Figure 2B:
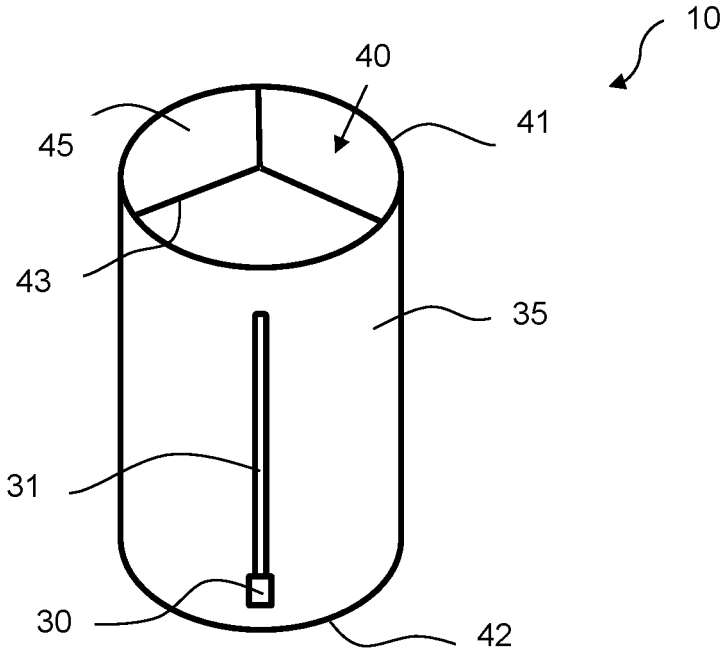
FIG. 2*b* is a perspective view of a container housing in accordance with some embodiments of the presently disclosed subject matter.
Figure 2C:
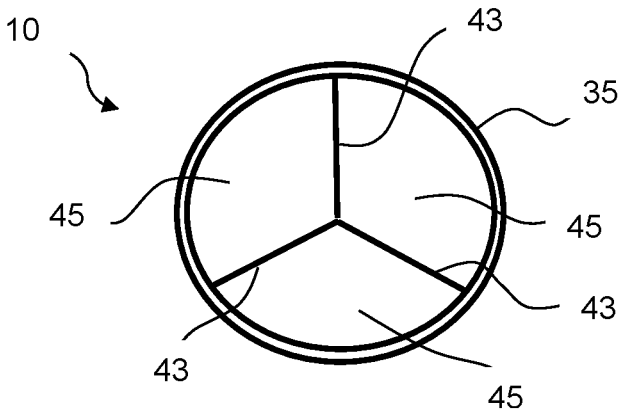
FIG. 2*c* is a top plan view of a container housing in accordance with some embodiments of the presently disclosed subject matter.

The housing includes interior 40 that comprises a plurality of compartments 45. The compartments are formed by interior walls 43 that extend along the length of the housing, as shown in FIGS. 2*b* and 2*c*. The housing can have any desired number of compartments, such as about 1-5 (e.g., 1, 2, 3, 4, or 5). In some embodiments, each compartment can be configured in about the same size and/or shape as adjacent compartments. However, the presently disclosed subject matter also includes embodiments wherein at least one compartment has a different size and/or shape compared to at least one other compartment (e.g., to house a different type or brand of lipstick).

The housing sidewall of each compartment includes slide 30 that travels along a corresponding vertical groove 31. The term "slide" refers to any element that can be grasped or gripped by the user. In some embodiments, slide 30 can include one or more gripping elements 100 to allow the user to more easily maneuver the slide, such as rubber strips, textured regions, ridges, and the like, as shown in FIG. 2*a*. The vertical groove can be constructed using any known mechanism, such as laser cutting, the use of sharp implements (e.g., scissors or blades), thermoforming, and the like. As discussed in detail below, the slide can be raised and lowered along the groove to extend or retract a desired lipstick from the interior of the housing.

Figure 2D:
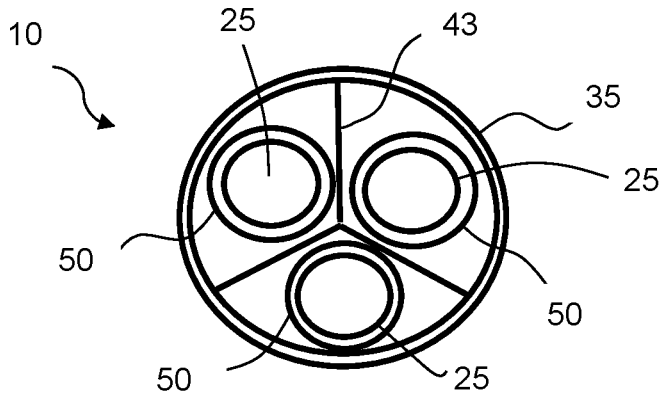
FIG. 2*d* is a top plan view of a container housing comprising a plurality of lipsticks in accordance with some embodiments of the presently disclosed subject matter.
Figure 2E:
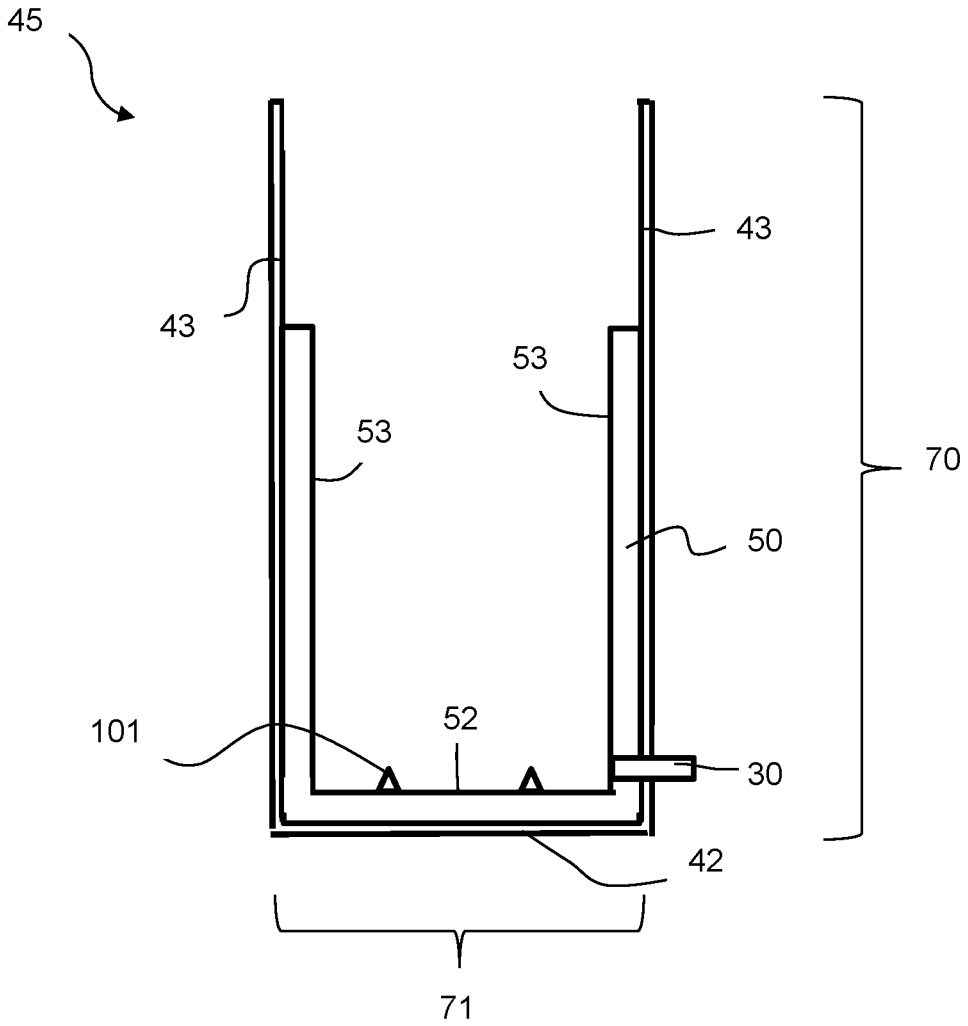
FIG. 2*e* is a cutaway view of a housing compartment in accordance with some embodiments of the presently disclosed subject matter.

Each compartment can be sized and shaped to house a single lipstick 25, as shown in the top plan view of FIG. 2*d*. Each compartment includes cup 50 that supports an individual lipstick 25. The term "cup" refers to any support element that can reinforce and/or protect a lipstick. In some embodiments, the cup fully or partially extends around the exterior of the lipstick. Thus, the cup includes bottom face 52 that provides a support surface upon which the lipstick rests, as shown in FIG. 2*e*. Bottom face 52 can include any retention element 101 to maintain the lipstick within the compartment and prevent movement. Suitable retention elements can include (but are not limited to) teeth, serrations, grooves, or any other grasping element. The cup can further include one or more sidewalls 53 that at least partially extend around the side of the compartment to protect the lipstick. Each cup sidewall is operably attached to slide 30 to independently raise and lower the cup via groove 31. For example, the slide can be adhesively or mechanically attached to the sidewall and/or cup. However, any interaction can be used to retain the slide, such as the use of magnets, clips, snap-fit attachment, and the like.

Each cup sidewall can have length 70 of about 0.5-2 inches (e.g., at least/no more than about 0.5, 1, 1.5, or 2 inches). Cup 50 can include width 71 of about 0.25-1.5 inches (0.25, 0.5, 0.75, 1, 1.25, or 1.5 inches).

Figure 2F:
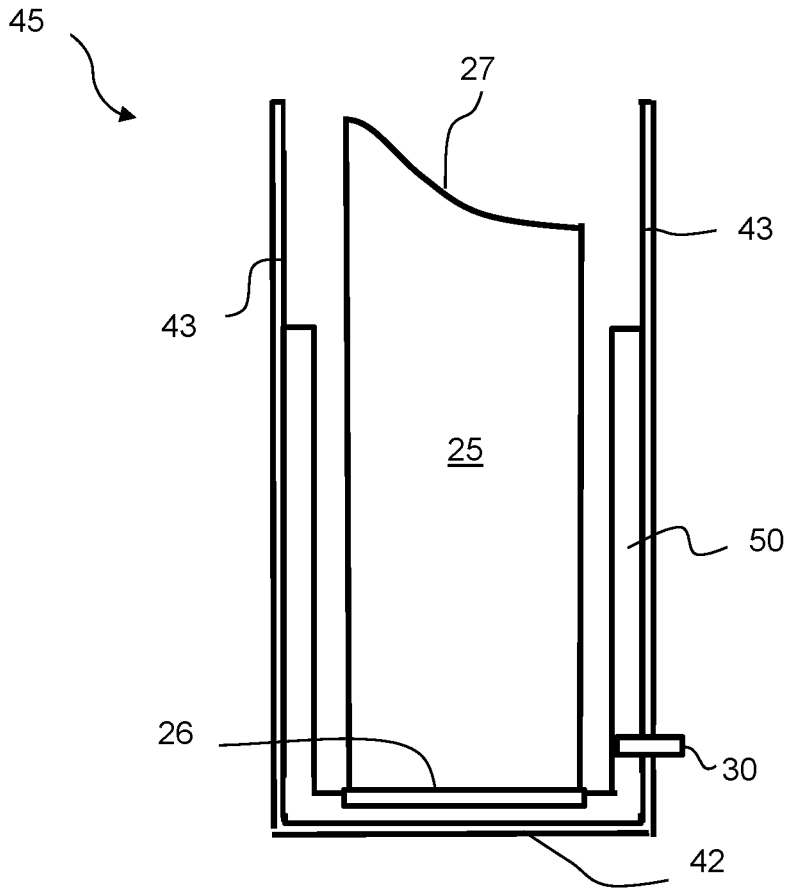
FIG. 2*f* is a cutaway view of a housing compartment comprising a lipstick in accordance with some embodiments of the presently disclosed subject matter.

A lipstick is permanently or releasably positioned within each cup using conventional mechanisms. As shown in FIG. 2*f*, bottom face 26 of the lipstick rests within the interior of cup 50, while top portion 27 of the lipstick extends beyond the cup. The lipstick can be configured in any desired color. In some embodiments, each lipstick of assembly 5 can have a different color. In some embodiments, the color of the lipsticks are selected to create a desired look or effect. Although lipstick 25 has a tapered top edge in FIG. 2*f*, any shaped lipstick can be used.

In some embodiments, the cup can be configured in a cylindrical shape. However, the cup can have any desired cross-sectional shape, such as (but not limited to) circular, oval, square, rectangular, triangular, pentagonal, hexagonal, octagonal, abstract, and the like.

Figure 3A:
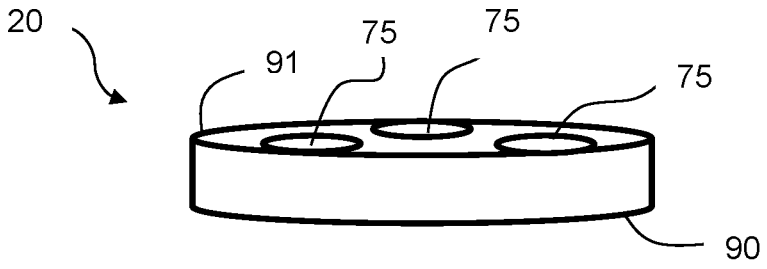
FIG. 3*a* is a perspective view of a container lid in accordance with some embodiments of the presently disclosed subject matter.
Figure 3B:
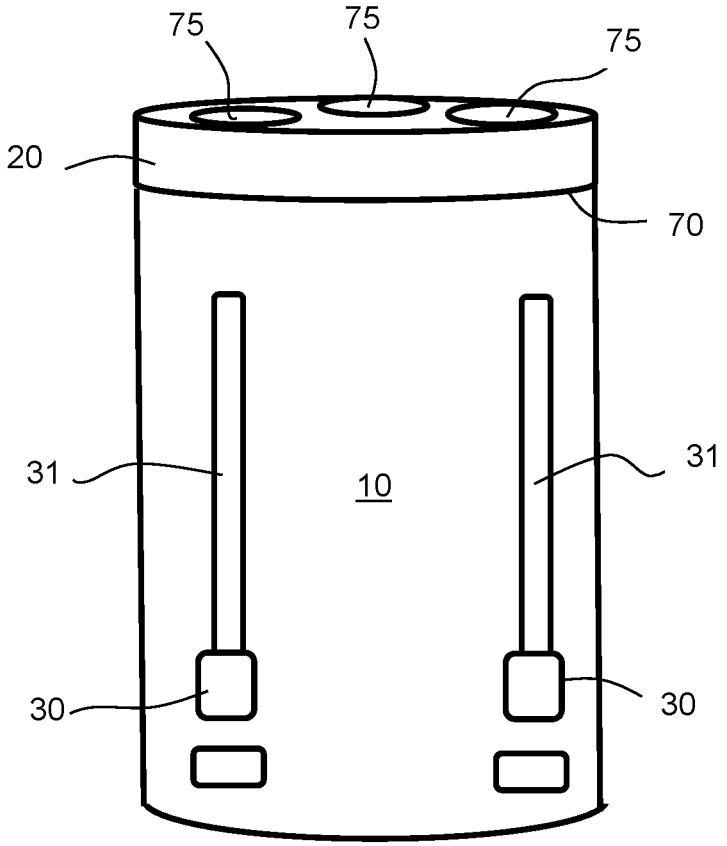
FIG. 3*b* is a perspective view of a container lid positioned on a housing in accordance with some embodiments of the presently disclosed subject matter.

Lipstick container assembly 5 further includes lid 20. The lid is designed to cover and enclose the interior of the housing for a more streamlined appearance. The lid also functions to provide protection to the lipstick against potentially damaging contact with items in a pocket or purse. One embodiment of lid 20 sized and shaped for attachment to the top edge of housing 10 is shown in FIGS. 3*a* and 3*b*. The lid includes bottom edge 90 that is positioned adjacent to top edge 41 of housing 10 using any mechanism, such as screw-fit attachment, snap-fit attachment, adhesive, welding, thermoforming, mechanical elements (e.g., screws, nuts, bolts, clasps), magnets, and the like. Top edge 91 of the lid includes outlet 75 sized and shaped to allow a portion of lipstick 25 to extend therethrough. Thus, the circumference of outlet 75 is larger than the circumference of lipstick 25. In some embodiments, the circumference of the outlet is about 5-50 percent larger than the circumference of the lipstick (i.e., at least/no more than about 5, 10, 15, 20, 25, 30, 35, 40, 45, or 50 percent).

The lid and housing can be constructed from any desired material or combination of materials. For example, suitable materials can include (but are not limited to) metal, plastic, ceramics, and the like.

The exterior surface of the housing and/or lid can be customizable. For example, one or more members of the disclosed assembly can include various colors, designs, patterns, and the like to provide a pleasing appearance to the user.

Optionally, the exterior portion of the housing can comprise one or more color indicators that are matched with each housing compartment. For example, the color indicator can include a window or colored portion that matches the color of lipstick housed within that particular compartment.

Figure 4A:
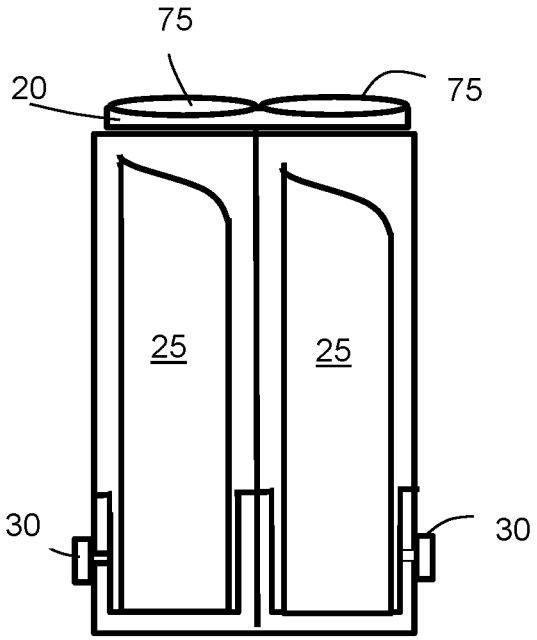
FIGS. 4*a*-4*c* are fragmentary views illustrating one method of using the disclosed container in accordance with some embodiments of the presently disclosed subject matter.
Figure 4B:
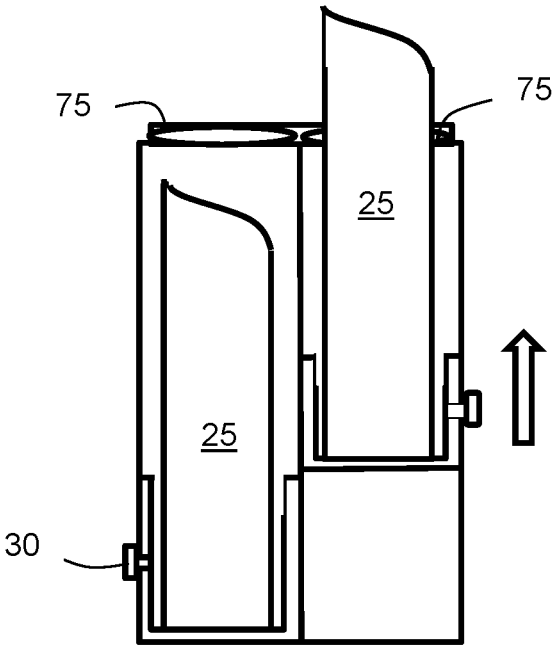
Figure 4C:
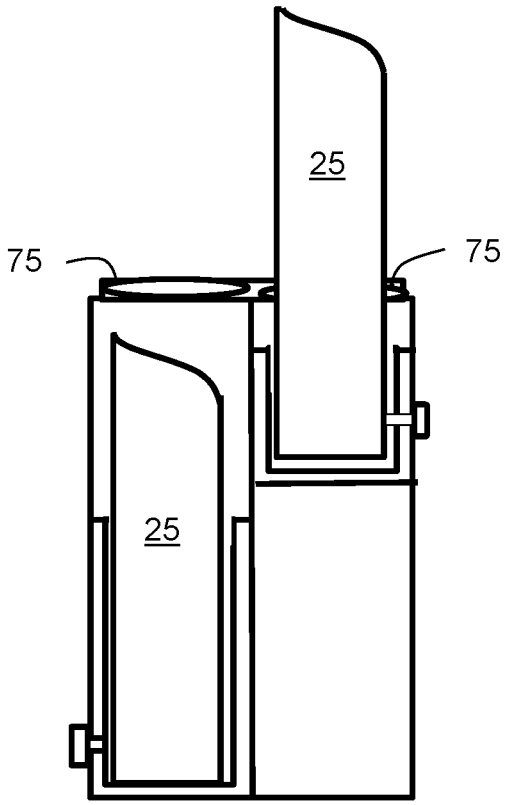

In use, when a user desires to access a particular lipstick shade, the user can grasp the appropriate slide 30. Each compartment of the assembly houses a lipstick and includes an exterior slide that can raise or lower the lipstick to and from the assembly, as shown in FIG. 4*a*. The slide and a selected cup 50 are thereby coupled together. Once the correct color lipstick is selected, the slide can be moved in an upward direction along groove 31 to raise and lower the cup (and the lipstick housed within the cup), as shown in FIG. 4*b*. Thus, lipstick 25 moves in an upward direction as the cup advances toward the lid and is exposed until the top portion of the lipstick extends through lid outlet 75, as shown in FIG. 4*c*. In this way, a desired color of lipstick 25 is accessed by the user. After use, the user can maneuver the slide in a downward direction, thereby retracting the lipstick to the storage position within the interior of the housing. In the storage position, each lipstick 25 is held firmly by the disclosed assembly for protection and until it is required by the user.

The disclosed lipstick container offers many advantages over the prior art. Particularly, the container allows the user access to several different shades of lipstick, all configured within the same container.

As disclosed above, the lipstick shades for a particular container can be selected for a desired effect. Container 5 therefore streamlines the ability of a user to get a desired look.

The lipstick container protects and secures each lipstick until needed. For example, each lipstick is housed within the housing interior and covered by lid 20. In this way the lipsticks are prevented from being damaged or encountering dirt and the like.

Because the container lid remains attached to the housing, the user does not have to precisely fit the lid on the container. That is, the lipstick is not damaged moving in and out of the container.

Container 5 saves the user time. Specifically, instead of trying to locate 3 different lipstick shades in the bottom of the purse, the disclosed container houses each shade to streamline the application of the lipsticks.

The container is easy to use, allowing even the elderly and pre-teen children to easily use.

Further, the disclosed assembly is simple to manufacture and can be inexpensively produced.

A plurality of lipsticks 25 therefore remain protected while stored, such as in the user's purse. Smears and long clean-ups are therefore avoided.

While this invention has been particularly shown and described with references to preferred embodiments thereof, it will be understood by those skilled in the art that various changes in form and details may be made herein without departing from the spirit and scope of the invention as defined by the appended claims.

What is claimed is:

1. A container for dispensing a lipstick, the container comprising:

a housing comprising:

a top end and a bottom end with a length therebetween;

an exterior surface and an interior surface;

an open top;

an interior defined by one or more interior walls that divide the entire interior into two or more compartments, each interior wall comprising at least one edge that contacts the housing interior surface along the full length of the housing, and wherein each interior wall passes through a midpoint of the housing interior, wherein each compartment is isolated from the remaining compartments, and wherein each compartment includes:

a cup slidable within the relative compartment, wherein each cup is defined by a bottom face and one or more cup sidewalls that extend away from the bottom face;

an exterior sidewall comprising two or more slides positioned within a vertical groove, wherein each slide is positioned adjacent to a compartment of the housing, and wherein each slide can move in an upward or downward direction within the vertical groove; and a lid comprising two or more outlets, each outlet aligned with a compartment of the housing;

wherein when the slide moves in a direction along the groove, the cup aligned with the slide also moves in the same direction.

2. The container of claim 1, wherein each cup comprises a lipstick.

3. The container of claim 2, wherein each lipstick is a different color compared to other lipsticks housed within the container.

4. The container of claim 1, wherein the slide comprises one or more gripping elements.

5. The container of claim 1, wherein the interior of the housing comprises about 2-6 compartments.

6. The container of claim 1, wherein a bottom surface of each cup comprises a retention element to retain a lipstick therein.

7. The container of claim 1, wherein the external surface of the housing comprises one or more gripping elements.

8. The container of claim 1, wherein the housing and lid are constructed from one or more rigid materials selected from metal, plastic, ceramics, or combinations thereof.

9. The container of claim 1, wherein the cup sidewall has a length that is at least half of the length of the housing interior walls.

10. The container of claim 1, wherein the interior housing walls divide the housing interior into two or more compartments of about the same size and shape.

11. The container of claim 1, wherein each interior housing wall is linear with a planar front edge and an opposed planar rear edge.

12. A method of accessing a lipstick housed within a container, the method comprising:

selecting a desired color lipstick positioned within a container, wherein the container comprises:

a top end and a bottom end with a length therebetween;

an exterior surface and an interior surface;

an open top;

an interior defined by one or more interior walls that divide the entire interior into two or more compartments, each interior wall comprising at least one edge that contacts the housing interior surface along the full length of the housing, and wherein each interior wall passes through a midpoint of the housing interior, wherein each compartment is isolated from the remaining compartments, and wherein each compartment includes:

a cup slidable within the relative compartment, wherein each cup is defined by a bottom face and one or more cup sidewalls that extend away from the bottom face;

an exterior sidewall comprising two or more slides positioned within a vertical groove, wherein each slide is positioned adjacent to a compartment of the housing, and wherein each slide can move in an upward or downward direction within the vertical groove; and a lid comprising two or more outlets, each outlet aligned with a compartment of the housing;

a lipstick positioned within the cup of each housing compartment;

wherein when the slide moves in a direction along the groove, the cup aligned with the slide also moves in the same direction;

moving the slide along the groove in an upward direction, such that the cup of the desired lipstick compartment moves in an upward direction until at least a portion of the lipstick extends through the lid outlet;

wherein the lipstick can be accessed as desired by a user.

13. The method of claim 12, further comprising moving the slide in a downward direction along the groove to recess the lipstick within the interior of the housing for storage.

14. The method of claim 12, wherein each lipstick is a different color compared to other lipsticks housed within the container.

15. The method of claim 12, wherein the slide comprises one or more gripping elements.

16. The method of claim 12, wherein the interior of the housing comprises about 2-6 compartments.

17. The method of claim 12, wherein a bottom surface of each cup comprises a retention element to retain a lipstick therein.

18. The method of claim 12, wherein each cup includes a sidewall.

19. The method of claim 12, wherein the external surface of the housing comprises one or more gripping elements.

20. The method of claim 12, wherein the housing and lid are constructed from one or more rigid materials selected from metal, plastic, ceramics, or combinations thereof.

* * * * *